US008281960B1

(12) United States Patent
Gers

(10) Patent No.: US 8,281,960 B1
(45) Date of Patent: Oct. 9, 2012

(54) ORBITAL BOTTLE WITH PUMP

(76) Inventor: Brandi N. Gers, Amelia, OH (US)

( * ) Notice: Subject to any disclaimer, the term of this patent is extended or adjusted under 35 U.S.C. 154(b) by 509 days.

(21) Appl. No.: 12/574,122

(22) Filed: Oct. 6, 2009

(51) Int. Cl.
*B67D 7/78* (2010.01)

(52) U.S. Cl. ..... 222/377; 222/382; 222/383.1; 222/464.3; 222/464.7

(58) Field of Classification Search ..... 222/341, 222/372, 377, 380, 381, 383.1, 464.1, 464.3, 222/464.5, 464.7, 382
See application file for complete search history.

(56) References Cited

U.S. PATENT DOCUMENTS

| | | | | |
|---|---|---|---|---|
| 2,953,284 | A | 9/1960 | Prussin et al. | |
| 4,889,441 | A | 12/1989 | Tice | |
| 4,953,791 | A * | 9/1990 | Tada | 239/333 |
| 5,522,548 | A * | 6/1996 | Gallien et al. | 239/337 |
| 5,655,714 | A * | 8/1997 | Kieffer et al. | 239/318 |
| 5,865,352 | A | 2/1999 | Leary | |
| 5,938,363 | A | 8/1999 | Timms et al. | |
| 6,439,441 | B1 | 8/2002 | Leary | |
| 6,834,815 | B2 * | 12/2004 | Appleby | 239/334 |
| 7,293,930 | B2 | 11/2007 | Chuang | |
| 2005/0092778 | A1 * | 5/2005 | Bistolfi | 222/383.1 |
| 2008/0121664 | A1 * | 5/2008 | Ophardt et al. | 222/321.9 |
| 2008/0223881 | A1 * | 9/2008 | Clynes | 222/383.1 |
| 2009/0230153 | A1 * | 9/2009 | Knight | 222/383.1 |
| 2010/0288794 | A1 * | 11/2010 | Chapin | 222/377 |

* cited by examiner

*Primary Examiner* — J. Casimer Jacyna
(74) *Attorney, Agent, or Firm* — Robert C. Montgomery; Joseph T. Yaksich; Montgomery Patent & Design, LLC

(57) ABSTRACT

A manual pump spray bottle, comprising a rotating coupling near the top of the container, thereby allowing a suction tube to swing about the entire perimeter of the bottle, is herein disclosed. The coupling provides a means such that no matter how the bottle is held, the tube is always at the lowest part and immersed in the liquid contents. The radius of the container bottom corresponds to that of the swing of the suction tube.

14 Claims, 3 Drawing Sheets

ORBITAL BOTTLE WITH PUMP

RELATED APPLICATIONS

The present invention was first described in a notarized Official Record of Invention on Nov. 6, 2008, that is on file at the offices of Montgomery Patent and Design, LLC, the entire disclosures of which are incorporated herein by reference.

FIELD OF THE INVENTION

The present invention relates generally to spray bottles, and more particularly, to a spray bottle having an rotating coupling for enabling a siphon tube to access an entire perimeter of the bottle during use.

BACKGROUND OF THE INVENTION

Spray and pump dispensers are a common dispensing method for a variety of products such as liquid soap, hand cream, lotions, sanitizing solutions, glass cleaner, general cleaning spray, car care products and the like.

Various types of bottles exist attempting to squirt, spray, mist, or otherwise dispense various types of liquids of varying viscosities. These attempts also include a variety of sizes, shapes, designs, and colors. Additionally, various types of dispensing means have been utilized depending on the type of liquid and the purpose of the sprayer.

These attempts include pump and squeeze activate dispensers for use with lotions or other liquids having a higher viscosity, as can be seen by example in U.S. Pat. No. 5,938,363, issued in the name of Timms et al., which describes a lotion dispensing device and U.S. Pat. No. 5,865,352, issued in the name of Leary, which describes a bottle for storing and dispensing viscous liquids from the bottom of the bottle.

Additionally, bottles having pressurized propellants have been utilized to dispense liquids in an aerosol spray. These attempts can be seen by example in U.S. Pat. No. 2,953,284, issued in the name of Prussin et al., which describes a pressurized dispenser for dispensing a relatively viscous material.

The trigger spray bottle which utilizes a positive displacement pump which acts directly on the fluid is the most popular. The primary disadvantage to trigger spray bottles is the necessity to rotate the container around, hold it perfectly level, or otherwise contort the position of the bottle to get most of the product out. Even then, a good portion of the product is left behind and is usually discarded. In fact, even a bottle with a fair amount of liquid may not work properly if the bottle is turned at an angle during spraying such that the liquid is not accessible by the siphon tube. This is due to the fact that the siphon tube that extends down from the pump or spray mechanism is limited to one location at the bottom center of the bottle.

While these devices fulfill their respective, particular objectives, they suffer from one or more of the aforementioned disadvantages. Accordingly, there exists a need for a means by which spray and pump bottles can be modified to address the above mentioned disadvantages. The development of the present invention substantially departs from the conventional solutions and in doing so fulfills this need.

SUMMARY OF THE INVENTION

In view of the foregoing references, the inventor recognized the aforementioned inherent problems and observed that there is a need for a bottle and spray pump for dispensing liquids with increased functionality that ensures the entire contents of the bottle can be used, reducing waste and thus, the object of the present invention is to solve the aforementioned disadvantages.

Another objective of the present invention is to provide a spray bottle which enables a user to access a small amount of liquid contained within the bottle as it collects around the lower perimeter of the bottle.

Another object of the present invention is to provide a spray bottle which eliminates the standard requirement of tipping the bottle to the side or similar undesirable position in order to utilize the pump and access the liquid.

To achieve the above objectives, the present invention provides a spray bottle comprising a bottle for storing a liquid, a spray pump which is removably attached to the bottle for manually dispensing the liquid, a tube that is rotatably coupled to the bottle and removably attached to the spray pump for carrying the liquid from the bottle to the spray pump, a snap fit attachment for removably attaching the spray pump to the bottle, and an interference fit attachment for removably coupling the tube to the bottle via a rotating coupling.

The bottle comprises a cylindrical bottle body with an opening for receiving the liquid. The bottle body has a neck that is narrower than the bottle body, side walls, and a bottom surface having a dome and an annular groove around a periphery of the dome. The bottom surface provides a means for the liquid to aggregate via gravity within the annular groove.

The spray pump comprises a spray head, an actuating means for drawing the liquid through the tube, a coupler that is removably attached to a top portion of the tube, and a nozzle for dispensing the liquid.

The tube comprises an open top end that is removably attached to the coupler on the spray pump and an open bottom end that is inserted into the bottle for receiving the liquid. The bottom tube end extends outward from the rotating coupler at a slight angle such that the bottom tube end is rotationally positioned in the annular groove.

The present invention provides a method of utilizing the device that provides a distinct improvement for the traditional hand operated pump dispensers by selective positioning the siphon tube in a desired location where an amount of liquid resides while not being dependent upon the orientation of the bottle.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | orbital bottle with pump |
| 20 | bottle |
| 21 | spray pump |
| 24 | convex portion |
| 26 | collar portion |
| 28 | locking protrusion |
| 30 | tube |
| 32 | coupler |
| 40 | rotating coupling |
| 50 | head |
| 51 | trigger lever |
| 51a | trigger fastener |
| 52 | locking recess |
| 53 | nozzle |
| 54 | reservoir |
| 55 | first piston |
| 56 | first spring |
| 57 | first ball |
| 58 | second piston |
| 59 | second spring |
| 60 | barrel |
| 61 | second ball |
| 70 | liquid |

DETAILED DESCRIPTION OF THE PREFERRED EMBODIMENT

Figure 1:
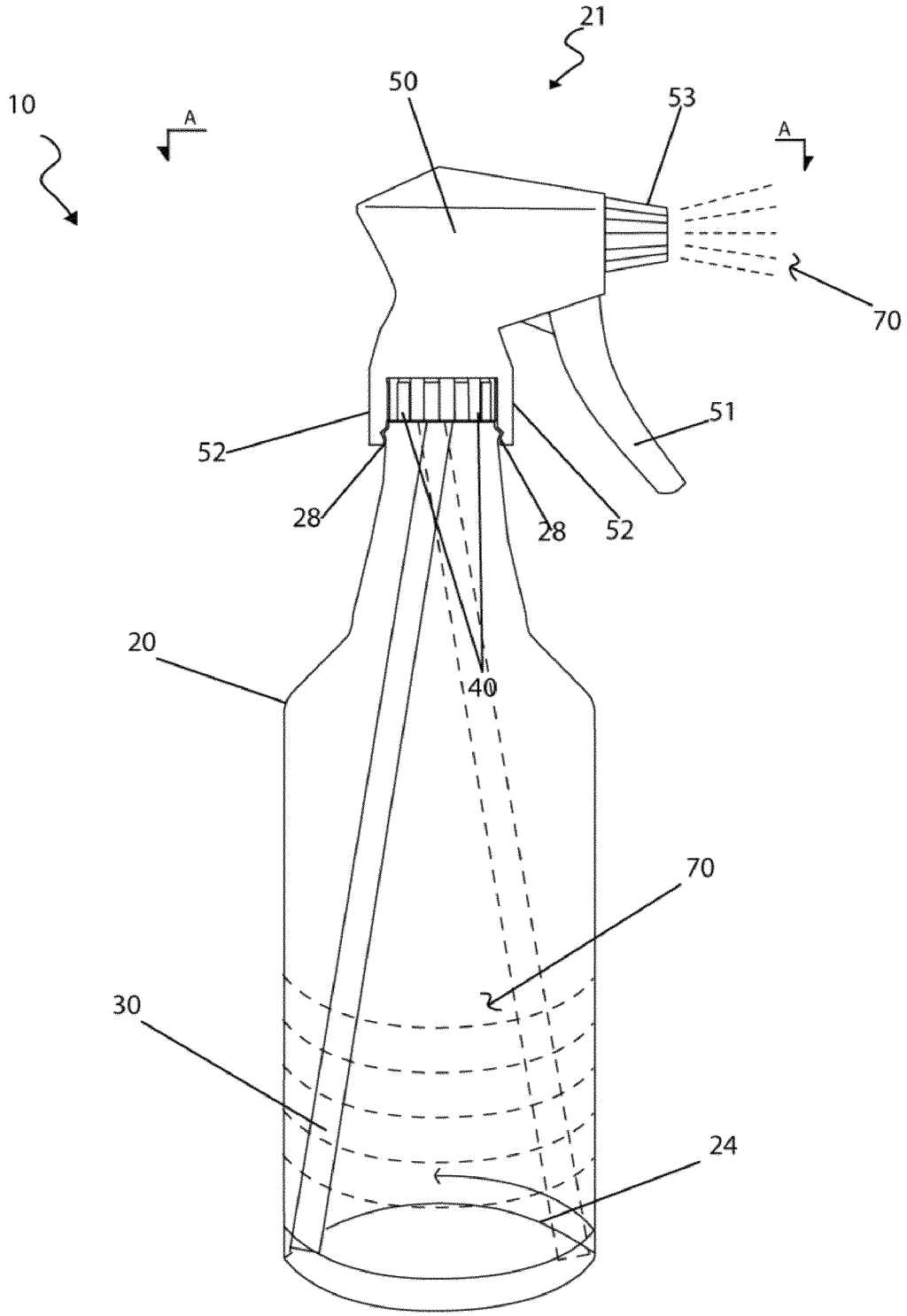
FIG. 1 is a front view of an orbital bottle with pump 10, according to a preferred embodiment of the present invention.
Figure 2:
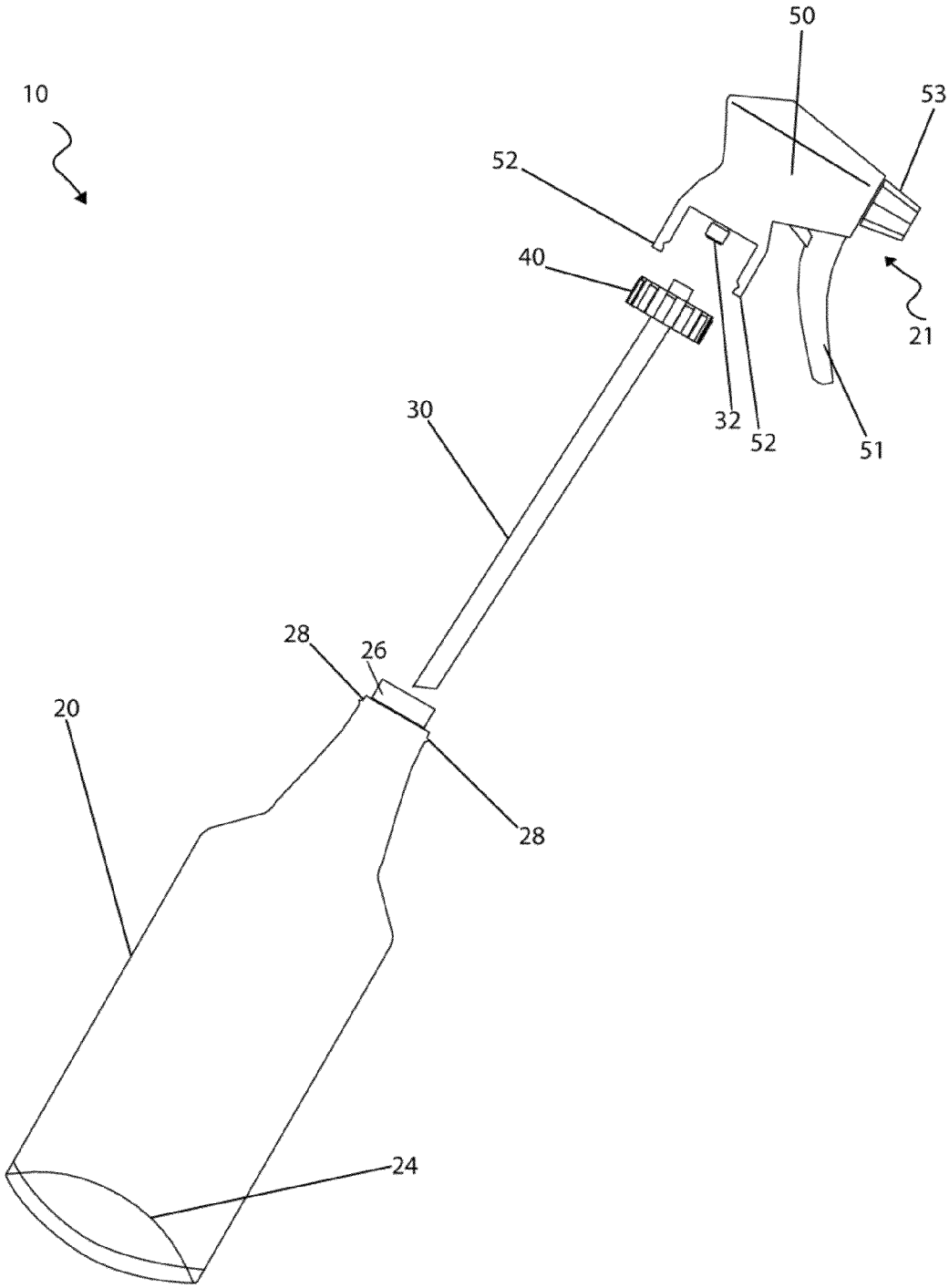
FIG. 2 is an exploded view of the orbital bottle with pump 10, according to a preferred embodiment of the present invention; and, FIG. 3 is a section view of the orbital bottle with pump 10 taken along section line A-A as shown on FIG. 1, according to a preferred embodiment of the present invention.
Figure 3:
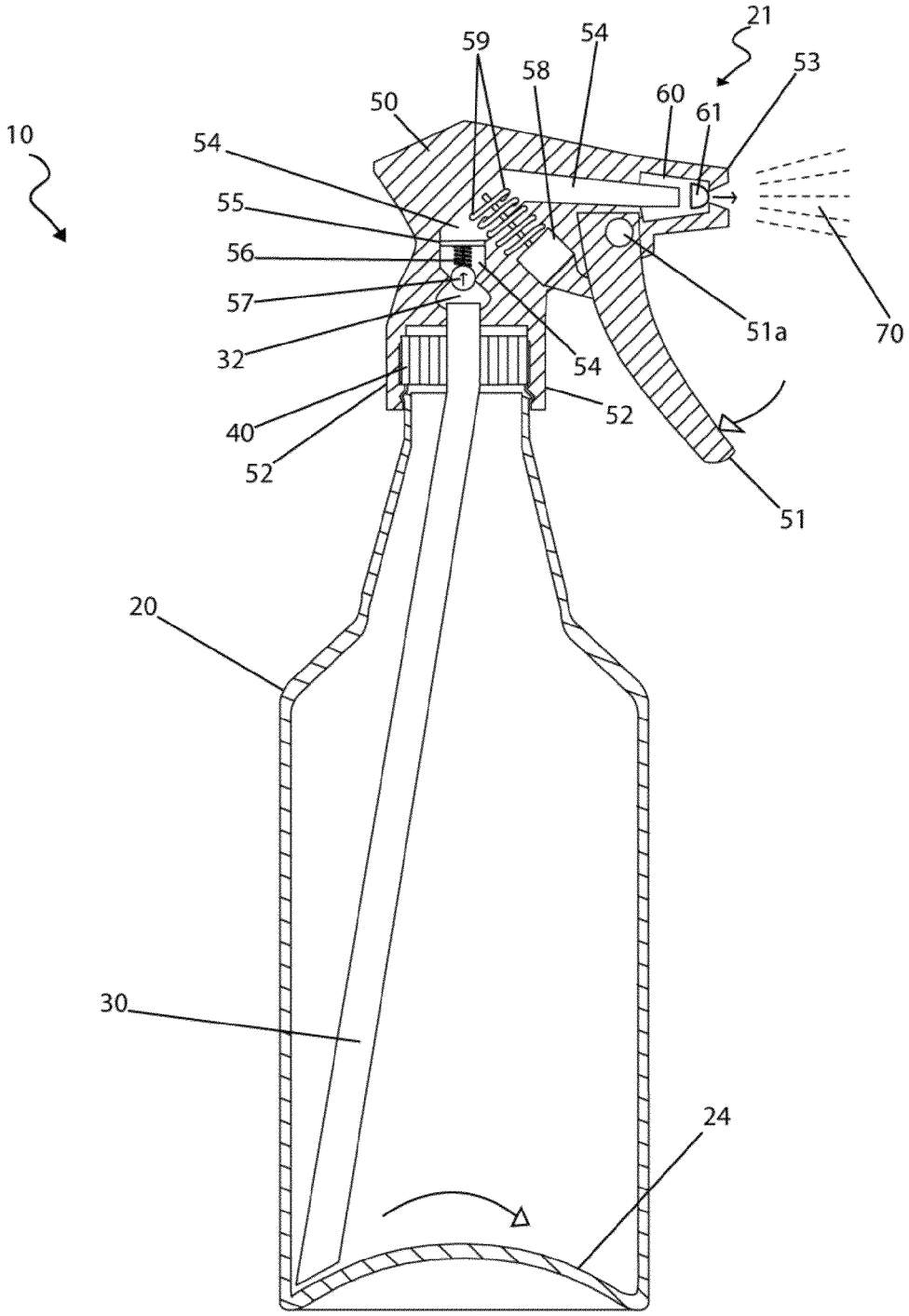

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an orbital bottle with pump (herein described as the "apparatus") 10, which provides a means and method for utilizing a manual pump spray bottle 20 comprising enhanced properties. Said apparatus 10 comprises a bottle 20, a spray pump 21, a tube 30, rotating coupling 40, a head 50, a nozzle 53, and other associated components. Said apparatus 10 is similar thereto conventional spray bottles 20 utilized for products such as, but not limited to: liquid soap, lotions, sanitizing solutions, general cleaning spray, and the like, yet comprises a rotating coupling 40, thereby enabling the tube 30 to swing about the entire bottom perimeter of the bottle 20, such that no matter how the apparatus 10 is held, the tube 30 is always at the lowest part and immersed in the liquid 70 contents.

Referring now to FIG. 1, a front view of the apparatus 10 and FIG. 2, an exploded view of the apparatus 10, according to the preferred embodiment of the present invention, are disclosed. Said apparatus 10 comprises a bottle 20, thereby providing containment means for the liquid 70. The bottle 20 comprises a convex portion 24, thereby providing an internally convex bottom having a dome with a smaller diameter compared to the bottle body and an annular groove around the periphery of the dome, thereby enabling gravity to pull the liquid 70 to the sides of said bottle 20. The bottle is preferably fabricated from a transparent plastic material in an injection molding process, thereby allowing a user to examine the amount of liquid 70 therewithin the bottle 20. Other materials may be incorporated for the fabrication of said bottle 20 therewithout limiting the functions of the apparatus 10 such as, but not limited to: glass, stainless steel, or the like. Further, the color of the material utilized for fabrication may also be differing such as, but not limited to: translucent, opaque, or the like without limiting the functions of the apparatus 10.

A top section of the bottle 20 further comprises a collar portion 26, thereby providing an interference fitted attachment means to a rotating coupling 40. Said collar portion 26 is integrally molded on a distal end of the top section of the bottle 20. Said rotating coupling 40 is a circular device therewith a knurled exterior which connects the tube 30 to the interior portion of the bottle 20. Said rotating coupling 40 comprises an integral slightly angled tube 30 which is rotationally positioned about the interior bottom surface of the bottle 20 which corresponded thereto the rotation of the rotating coupling 40. Said tube 30 is preferably an appropriate length thereto engage the bottom perimeter of the bottle 20. The tube 30 and rotating coupling 40 are preferably fabricated from a plastic material or other material similar thereto the bottle 20.

The bottle 20 yet further comprises a pair of locking protrusions 28, thereby providing an attachment means for the head 50 to said bottle 20. The locking protrusions 28 are subjacent to the collar portion 26 and mate therewith a pair of locking recesses 52 which are located on an end portion of the head 50. Said locking recesses 52 slidably engage each locking protrusion 28, thereby fixing the head 50 in a locked and set position. The locking protrusions 28 are molded thereinto the bottle 20 and the locking recesses are molded thereinto the head 50 each during the injection molding process.

A spray pump 21 comprises a head 50 which also comprises a conventional coupler 32, thereby providing an attachment means to a top portion of the tube 30. Said top portion of the tube 30 extends above the rotating coupling 40, thereby providing the abovementioned coupler 32 therewith an attachment means. Said coupler 32 slidably engages the top portion of the tube 30 thereto encompasses said tube 30. The coupler 32 is also fabricated from a similar material as the tube 30.

Said head 50 further comprises a trigger lever 51, thereby activating a pair of internal one-way valves thereto discharge liquid 70 from a conventional nozzle 53 (see FIG. 3). The nozzle 53 provides a concentrated stream or flow of liquid 70 out of the bottle 20. The nozzle 53 may comprise a variety of settings such as, but not limited to: off, on, spray, stream, or the like, similar thereto conventional spray bottle nozzles thereby allowing a user to control the discharge of liquid 70. The trigger lever 51 is located subjacent to the nozzle and is fabricated from a material similar thereto the bottle 20.

Referring now to FIG. 3, a section view of the apparatus 10 taken along section line A-A as shown on FIG. 1, according to the preferred embodiment of the present invention, is disclosed. The head 50 of the apparatus 10 internally comprises a reservoir 54, a pair of balls 57, 61, a barrel 60, and a pair of one-way valves which are comprised of a pair of pistons 55, 58 and a pair of springs 56, 59. Liquid 70 is pulled thereinto the tube 30 by depressing the trigger lever 51, thereby simultaneously enabling the first piston 55 and second piston 58 to be forced upwardly by means of a first spring 56 and second spring 59, respectively. As the first piston 55 and first spring 56 are retracted an attached first ball 57 is also retracted, thereby allowing the liquid 70 to flow into the reservoir 54 filling said reservoir 54 with the liquid 70. The liquid 70 also flows into a barrel 60 located thereinside of the nozzle 53 which forces a second ball 61 to move outwardly allowing the fluid to exit the nozzle 53 and concurrently spray the liquid 70. When the trigger lever 51 is released the first ball 57 retracts to a resting position, thereby prohibiting liquid 70 to enter the reservoir 54. At the same time, the second ball 61 also retracts to its resting position, thereby prohibiting air from entering the nozzle 53.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: acquiring the apparatus 10; filling said apparatus 10 with a desired liquid 70, if not previously filled; engaging the rotating coupling 40 onto the collar portion 26; positioning the pair of locking recesses 52 on top of the locking protrusions 28, thereby fastening the head 50 into a locked position; depressing the trigger 51, thereby depressing the pistons 55, 58 and the springs 56, 59; allowing the liquid 70 to be pulled upwardly into the tube 30, causing the first ball 57 to move upward, filling the reservoir 54 and barrel 60, and causing the second ball 61 to move outwardly to dispose the liquid 70; releasing the trigger lever 51 allowing the first ball 57 to drop, filling reservoir 54 and barrel 60 therewith the liquid 70, and positioning the second ball 61 to a resting position; depressing the trigger lever 51 a desired amount of times thereto repeat the above-mentioned steps as necessary; rotating the rotating coupler 40 thereto turn the tube 30 and position said tube 30 in a desired location, thereby enabling the user to completely empty the contents of the bottle 20; refilling the bottle 20 as necessary with the liquid 70; and, utilizing the apparatus 10 thereto dispense liquids 70 and reducing waste of said liquid 70 contents.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A spray bottle comprising:

a bottle comprising an interior;

a spray pump removably attached thereto said bottle for manually dispensing a liquid, further comprising:

a spray head for being engaged by a user's hand;

an actuating means for drawing said liquid through a tube, said actuating means comprising a trigger lever hingedly attached to said spray head for activating a pair of one-way valves comprising a first valve having a first piston and a first spring and a second valve having a second piston and a second spring, a reservoir, a first ball and a second ball, and a barrel;

a coupler removably attached to a top portion of said tube for fluid communication between said tube and said actuating means; and, a nozzle for dispensing said liquid;

said tube rotatably coupled thereto and in fluid communication therewith said bottle and removably attached thereto said spray pump, further comprising a snap fit attachment for removably attaching said spray pump thereto said bottle; and, an interference fit attachment for removably coupling said tube thereto said bottle via a rotating coupling;

wherein said liquid is pulled into said tube when said trigger lever is depressed, thereby simultaneously enabling said first piston and said second piston to be forced upwardly by means of said first spring and said second spring, respectively;

wherein said first piston and said first spring are retracted so as to retract said first ball, thereby allowing said liquid to flow into said reservoir;

wherein said liquid flows into said barrel provided inside of said nozzle which forces said second ball to move outwardly, thus enabling said fluid to exit said nozzle;

wherein said first ball retracts to a first resting position upon release of said trigger lever, thereby prohibiting said liquid from entering said reservoir;

wherein simultaneously said second ball retracts to a second resting position upon release of said trigger lever, thereby prohibiting air from entering said nozzle;

wherein said interior of said bottle retains an amount of liquid therein; and, wherein said tube conveys said liquid therefrom said interior thereto said spray pump.

2. The spray bottle of claim 1, wherein said bottle further comprises:

a cylindrical bottle body comprising a neck that is narrower than said bottle body, side walls, and a bottom surface having a dome and an annular groove therearound a periphery of said dome; and, an opening for receiving said liquid;

wherein said bottle body forms said interior for storing said amount of said liquid contained therewithin; and, wherein said bottom surface provides a means for said liquid to aggregate via gravity therewithin said annular groove.

3. The spray bottle of claim 1, wherein said tube further comprises:

an open top end removably attached thereto a coupler thereon said spray pump for fluid communication therewith said spray pump; and, an open bottom end inserted thereinto said bottle therethrough an opening for receiving said liquid for fluid communication therewith said liquid;

wherein said rotating coupling is affixed thereto said tube therethrough a center aperture subjacent thereto said open top end; and, wherein said bottom tube end extends outward therefrom said center aperture at a slight angle such that said bottom tube end is rotationally positioned thereabout an annular groove therearound a periphery of a bottom interior surface of said bottle.

4. The spray bottle of claim 1, wherein said snap fit attachment further comprises two opposed protrusions thereon an upper portion of said bottle which engage corresponding recesses thereon an inner surface of a lower portion of said spray pump;

wherein said protrusions are located thereon a neck of said bottle subjacent thereto an annular collar portion; and, wherein said recesses are located thereon lower ends of two cantilevers extending therefrom a bottom end of a spray head of said spray pump.

5. The spray bottle of claim 1 wherein said interference fit attachment further comprises an annular collar portion thereon an upper portion of said bottle which attaches thereinto said rotating coupling of said tube;

wherein said collar portion is located thereon an exterior surface of a neck of said bottle subjacent thereto an opening for receiving said liquid; and, wherein said rotating coupling comprises a cover rotatable relative thereto said collar portion which covers said opening for receiving said liquid.

6. The spray bottle of claim 1, wherein said rotating coupling comprises a knurled exterior for increased gripping by a hand of a user.

7. The spray bottle of claim 3, wherein said tube is integrally molded thereinto said rotating coupling.

8. The orbital bottle with a spray pump of claim 1, wherein said dome comprises a diameter less than that of an internal diameter of said bottle body.

9. The orbital bottle with a spray pump of claim 1, wherein said bottle body further comprises a transparent plastic material, such that said amount of liquid therewithin may be observed.

10. A spray bottle comprising:

a bottle comprising an interior, a cylindrical bottle body, and an opening for receiving a liquid;

wherein said bottle body comprises a neck that is narrower than said bottle body, side walls, and a bottom surface having a dome and an annular groove therearound a periphery of said dome;

wherein said bottle body forms said interior for storing an amount of said liquid contained therewithin;

wherein said bottom surface provides a means for said liquid to aggregate via gravity therewithin said annular groove;

a spray pump for manually dispensing said liquid comprising a spray head for being engaged by a user's hand, an actuating means for drawing said liquid therethrough said tube, and a coupler removably attached thereto a top portion of said tube for fluid communication therebetween said tube and said actuating means;

a nozzle for dispensing said liquid;

a tube rotatably coupled thereto and in fluid communication therewith said bottle and removably attached thereto said spray pump comprising an open top end removably attached thereto said coupler thereon said spray pump for fluid communication therewith said spray pump and an open bottom end inserted thereinto said bottle therethrough said opening for receiving said liquid for fluid communication therewith said liquid;

wherein said actuating means further comprises:

a trigger lever hingedly attached to said spray head for activating a pair of one-way valves comprising a first valve having a first piston and a first spring and a second valve having a second piston and a second spring;

a first ball and a second ball;

a reservoir; and, a barrel;

wherein said liquid is pulled into said tube when said trigger lever is depressed, thereby simultaneously enabling said first piston and said second piston to be forced upwardly by means of said first spring and said second spring, respectively;

wherein said first piston and said first spring are retracted so as to retract said first ball, thereby allowing said liquid to flow into said reservoir;

wherein said liquid flows into said barrel provided inside of said nozzle which forces said second ball to move outwardly, thus enabling said fluid to exit said nozzle;

wherein said first ball retracts to a first resting position upon release of said trigger lever, thereby prohibiting said liquid from entering said reservoir;

wherein simultaneously said second ball retracts to a second resting position upon release of said trigger lever, thereby prohibiting air from entering said nozzle;

wherein a rotating coupling is affixed to said tube through a center aperture subjacent to said open top end; and, wherein said bottom tube end extends outward from said center aperture at a slight angle such that said bottom tube end is rotationally positioned about said annular groove around a periphery of a bottom interior surface of said bottle;

a snap fit attachment for removably attaching said spray pump thereto said bottle; and, an interference fit attachment for removably coupling said tube thereto said bottle via said rotating coupling.

11. The spray bottle of claim 10, wherein said snap fit attachment further comprises two opposed protrusions thereon said neck of said bottle subjacent thereto an annular collar portion which engage corresponding recesses thereon an inner surface of a lower portion of said spray pump;

wherein said recesses are located thereon lower ends of two cantilevers extending therefrom a bottom end of a spray head of said spray pump.

12. The spray bottle of claim 10 wherein said interference fit attachment further comprises an annular collar portion thereon an outer surface of said neck of said bottle subjacent thereto said opening for receiving said liquid which attaches thereinto said rotating coupling of said tube;

wherein said rotating coupling comprises a cover rotatable relative thereto said collar portion which covers said opening for receiving said liquid.

13. The spray bottle of claim 11 wherein said interference fit attachment further comprises an annular collar portion thereon an outer surface of said neck of said bottle subjacent thereto said opening for receiving said liquid which attaches thereinto said rotating coupling of said tube;

wherein said rotating coupling comprises a cover rotatable relative thereto said collar portion which covers said opening for receiving said liquid.

14. A method of utilizing a spray bottle, comprising the steps:

acquiring said spray bottle comprising a bottle comprising an interior, a cylindrical bottle body, and an opening for receiving a liquid; wherein said bottle body comprises a neck that is narrower than said bottle body, side walls, and a bottom surface having a dome and an annular groove therearound a periphery of said dome; wherein said bottle body forms said interior for storing an amount of said liquid contained therewithin; and, wherein said bottom surface provides a means for said liquid to aggregate via gravity therewithin said annular groove; a spray pump for manually dispensing said liquid comprising a spray head for being engaged by a user's hand, an actuating means for drawing said liquid therethrough said tube comprising a trigger lever hingedly attached thereto said spray head for activating a pair of one-way valves comprising a first valve having a first ball and a first spring and a second valve having a second ball and a second spring, a pair of balls comprising a first ball and a second ball, a reservoir, and a barrel; wherein said liquid is pulled thereinto said tube when said trigger lever is depressing, thereby simultaneously enabling said first piston and said second piston to be forced upwardly by means of said first spring and said second spring, respectively; wherein said first piston and said first spring are retracted so as to retract said first ball, thereby allowing said liquid to flow into said reservoir; wherein said liquid flows thereinto said barrel provided thereinside of said nozzle which forces said second ball to move outwardly, thus enabling said fluid to exit said nozzle; wherein said first ball retracts thereto a first resting position upon release of said trigger lever, thereby prohibiting said liquid from entering said reservoir; and, wherein simultaneously said second ball retracts thereto a second resting position upon release of said trigger lever, thereby prohibiting air from entering said nozzle; and, a coupler removably attached thereto a top portion of said tube for fluid communication therebetween said tube and said actuating means; a nozzle for dispensing said liquid; a tube rotatably coupled thereto and in fluid communication therewith said bottle and removably attached thereto said spray pump comprising an open top end removably attached thereto said coupler thereon said spray pump for fluid communication therewith said spray pump and an open bottom end inserted thereinto said bottle therethrough said opening for receiving said liquid for fluid communication therewith said liquid; wherein a rotating coupling is affixed thereto said tube therethrough a center aperture subjacent thereto said open top end; and, wherein said bottom tube end extends outward therefrom said center aperture at a slight angle such that said bottom tube end is rotationally positioned thereabout said annular groove therearound a periphery of a bottom interior surface of said bottle; a snap fit attachment for removably attaching said spray pump thereto said bottle comprising two opposed protrusions thereon said neck of said bottle subjacent thereto an annular collar portion which engage corresponding recesses thereon an inner surface of a lower portion of said spray pump; wherein said recesses are located thereon lower ends of two cantilevers extending therefrom a bottom end of said spray head of said spray pump; and, an interference fit attachment for removably coupling said tube thereto said bottle via said rotating coupling comprising said annular collar portion thereon an outer surface of said neck of said bottle subjacent thereto said opening for receiving said liquid which attaches thereinto said rotating coupling of said tube; wherein said rotating coupling comprises a cover rotatable relative thereto said collar portion which covers said opening for receiving said liquid;

filling said bottle body with said liquid, if not previously filled;

engaging said rotating coupling thereonto said collar portion;

positioning said pair of recesses thereon top of said pair of protrusions, thereby fastening said spray head thereinto a locked position;

depressing a trigger lever, thereby depressing internal pistons and springs;

allowing said liquid to be pulled upwardly thereinto said tube, causing said first ball to move upward, filling said reservoir and said barrel, and causing said second ball to move outwardly to dispose said liquid;

releasing said trigger lever allowing said first ball to drop, filling said reservoir and said barrel therewith said liquid, thereby positioning said second ball thereat said second resting position;

depressing said trigger lever a desired amount of times so as to repeat the abovementioned steps as desired;

rotating said rotating coupler so as to rotate said tube and position said tube therein a desired location, thereby enabling a user to completely empty said liquid therefrom said spray bottle;

refilling said bottle body as necessary with said liquid; and, utilizing said spray bottle to dispense said liquid, thus reducing waste of said liquid contents.

* * * * *